US005246089A

United States Patent [19]

Husmann et al.

[11] Patent Number: 5,246,089

[45] Date of Patent: Sep. 21, 1993

[54] DOOR DRIVE APPARATUS WITH LOCKING MECHANISM FOR ELEVATORS

[75] Inventors: Josef Husmann, Luzern; Franz Weingertner, Ebikon, both of Switzerland

[73] Assignee: Inventio AG, Hergiswil NW, Switzerland

[21] Appl. No.: 882,700

[22] Filed: May 14, 1992

[30] Foreign Application Priority Data

May 14, 1991 [CH] Switzerland ..... 01436/91

[51] Int. Cl.[5] ..... B66B 13/00

[52] U.S. Cl. ..... 187/52 LC; 49/118

[58] Field of Search ..... 187/52 LC, 51, 57, 52 R, 187/61; 49/116, 120, 118

[56] References Cited

U.S. PATENT DOCUMENTS 2,816,625 12/1952 McCormick ..... 187/52 LC
3,605,952 9/1971 Lusti ..... 187/51
4,947,964 8/1990 Husmann ..... 187/52 LC

FOREIGN PATENT DOCUMENTS 0164581 2/1981 European Pat. Off. .
2461674 2/1981 France .
2625991 7/1989 France .

*Primary Examiner*—Robert P. Olszewski
*Assistant Examiner*—Kenneth Noland
*Attorney, Agent, or Firm*—William J. Clemens

[57] ABSTRACT

A door drive apparatus with a locking mechanism for elevator doors permits the opening of the car door situated in the region of a floor together with a coupled-on shaft door, driven automatically in the normal case or manually in the case of a power failure. If the elevator car is situated outside a floor region, the car door remains locked. A control cam mounted at the upper end of a car door leaf is connected with a door drive by a belted drive means and causes a low-jerk opening and closing of the car door at the closing end of travel. The control cam is connected by a pull rod to an entraining member parallelogram for the coupling of the shaft door to the car door. A locking mechanism on the upper end of the same door leaf has an actuating roller which is actuated by a double lever connected to the control cam and the pull rod for the unlocking when the car is located in the door opening region of a floor.

11 Claims, 5 Drawing Sheets

1
2
3
4
5
6
7
8
9
10.1
10.2
10.3
11.1
11.2
11.3
12.1
12.2
12.3
16
17
18
19
20
23
46
54

DOOR DRIVE APPARATUS WITH LOCKING MECHANISM FOR ELEVATORS

BACKGROUND OF THE INVENTION

The present invention relates generally to elevators and, in particular, to an elevator door drive apparatus with a door locking mechanism.

A door drive device with a latching mechanism for use with elevators is shown in the European patent document EP-OS 0 164 581. The device includes an entraining member parallelogram which is arranged at the car door for the coupling of the car door with a shaft door through cooperation with two rollers fastened at each shaft door. A pawl, which is controlled by the entraining member parallelogram and an angle lever, on the one hand holds the car door in a latched setting with the entraining member parallelogram closed to permit the free passage of the car past a floor and, on the other hand, unlatches the car door with the fully opened entraining member parallelogram adjacent a floor, for example in the case of a power failure. The pawl is opened when the car is situated in the region of a floor by a control roller attached to an angle lever which roller runs up onto a control cam located at the shaft door and turns the angle lever which releases the pawl from the latching position. This unlatching takes place for every destination floor or, in the case of a power failure, when the elevator car is situated within the door opening zone of a floor. The car door and the coupled shaft door are, according to the state of the elevator control, either opened automatically by the door drive or can be pushed open manually. The car door, however, remains latched when the elevator car, for example in the case of a power failure, is situated outside the door opening zone of a floor.

A disadvantage of the above-described device is that a control cam is required at each shaft door on each floor for unlatching the car door. These control cams must cooperate exactly with the drive device located on the car and, therefore, require accurate and expensive installation procedures at the building site.

Another elevator door drive device with a latching mechanism with a similar mode of construction is shown in the European patent document EP-A-0 332 841. In this device, the car door is likewise connected with the shaft door by a coupling mechanism in the region of the floors, wherein again an entraining member parallelogram located at a car door leaf and two coupling rollers arranged at each shaft door leaf cooperate. The closed entraining member parallelogram passes between the coupling rollers of a shaft door during travel past a floor, but couples with the coupling rollers through the opening of the entraining member parallelogram at a destination or target floor. The closing of the entraining member parallelogram in the normal case is actuated through the door drive device. An actuating lever, which is connected with a belted drive means of the door drive device and the entraining member parallelogram and which is pivotable to and fro between two fixedly placed elastic abutments, closes the entraining member parallelogram through a pivotal movement in a counterclockwise direction. The opening of the entraining member parallelogram is performed by the application of force applied by a tension spring engaging the actuating lever and the base plate of the entraining member parallelogram, either in the case of a lack of power to the drive motor or in the case of reversing of the drive motor, which is regulated by a microprocessor, to the opening direction. If this opening takes place within the door opening zone of a floor, the entraining member parallelogram is held by the coupling rollers of the shaft door in a central position, wherein a ramp cam of the entraining member parallelogram is pressed together in a parallel direction and a control cam located at the ramp curve unlatches the car door latch. At the same time, the entraining member parallelogram is latched in this central position by an additional latching device.

Disadvantages of this device are that a laborious and expensive installation procedure is required for the door drive motor for an unobjectionable door actuation, that the entraining member parallelogram and the car door latching means are arranged spatially one beside the other and the door drive device is usable only conditionally when different height shaft doors must be actuated for the same elevator, and that an additional latching device is required for the open entraining member parallelogram for the opening movement of the doors by the door drive device.

SUMMARY OF THE INVENTION

The present invention is based on the task of providing a door drive apparatus in which no control cams are required at the individual shaft doors for the unlocking of the car door locking means, which sets lower quality demands on the door motor control and installation thereof, and which requires no additional locking for the entraining member parallelogram.

The present invention concerns an apparatus for operating a car door, which car door is connected through a coupling mechanism with a shaft door and is movable in the region of the floors by a door drive. The coupling mechanism consists of an entraining member parallelogram mounted on a car door leaf and two coupling rollers located at each shaft door. The door drive comprises a drive motor located above the car, an intermediate gear, and a belted drive means which is connected through an actuating means with the car door and fixes the car door in the closed and in the open positions. The locking mechanism comprises a pivotally mounted car door latch, which latch is monitored by a safety contact, is arrestable at an abutment, locks by its own weight in a retaining position and which is urgeable by an actuating means into a releasing position.

The door drive apparatus with locking mechanism for an elevator includes a n entraining member parallelogram mounted on a car door of an elevator; a control cam rotatably mounted on the car door for actuating the entraining member parallelogram; a hinge pin attached to the control cam and projecting into a cutout formed in a metal retaining plate attached to the car door, and an elastic buffer attached to the hinge pin for abutting an end of the cutout to limit rotation of the control cam in an opening direction. A pull rod is connected between the entraining member parallelogram and the control cam; a toggle lever is connected between the control cam and a drive means for the car door for rotating the control cam when the drive means moves the car door; and a roller is fixedly and rotatably attached to the elevator car and abuts a periphery of the control cam. An actuating strap having an actuating roller attached to one end is guided in a groove formed in the metal retaining plate and is pivotally connected at an opposite end to a car door latch. A double lever is rotatably mounted on the control cam and is pivotally connected at one end with the pull rod, an opposite end of the double lever abutting the actuating roller upon upward movement of the pull rod and urging the actuating strap upwardly. An abutment is formed on the pull rod for retaining the double lever in a rest position, the double lever being urged into the rest position by the force of a tension spring connected between the double lever and the pull rod. A ramp cam is mounted on the pull rod which, in an open position of the entraining member parallelogram, contacts a support roller attached to the car door. A length equalization device can be attached to the pull rod for adjusting the pull rod to a predetermined length.

The advantages achieved by the present invention are substantially that it is possible through the spatially separate arrangement of the locking means and of the entraining member parallelogram to effectively extend the entraining member parallelogram downwardly through an elongation of the pull rod connecting both the parts together. This permits a simple adaptation for the coupling between the car door and the shaft door in the case of different shaft door heights encountered by the same elevator. With this arrangement, it is also possible in simple manner to provide special entraining member parallelograms which are drawn away from the shaft door threshold during the car travel for enlargement of the critical clearance in the shaft for the car.

A further advantage is that the actuation of the entraining member parallelogram, as well as the beginning of the door movement through a control cam and a toggle lever, enables a low-jerk opening and closing of the entraining member parallelogram and the door on the closing end. Thereby, the door motor control and regulation of comparatively similar door drives can be simplified and the associated expense reduced substantially.

BRIEF DESCRIPTION OF THE DRAWINGS

The above, as well as other advantages of the present invention, will become readily apparent to those skilled in the art from the following detailed description of a preferred embodiment when considered in the light of the accompanying drawings in which.

DESCRIPTION OF THE PREFERRED EMBODIMENT

Figures 1, 2, 3:
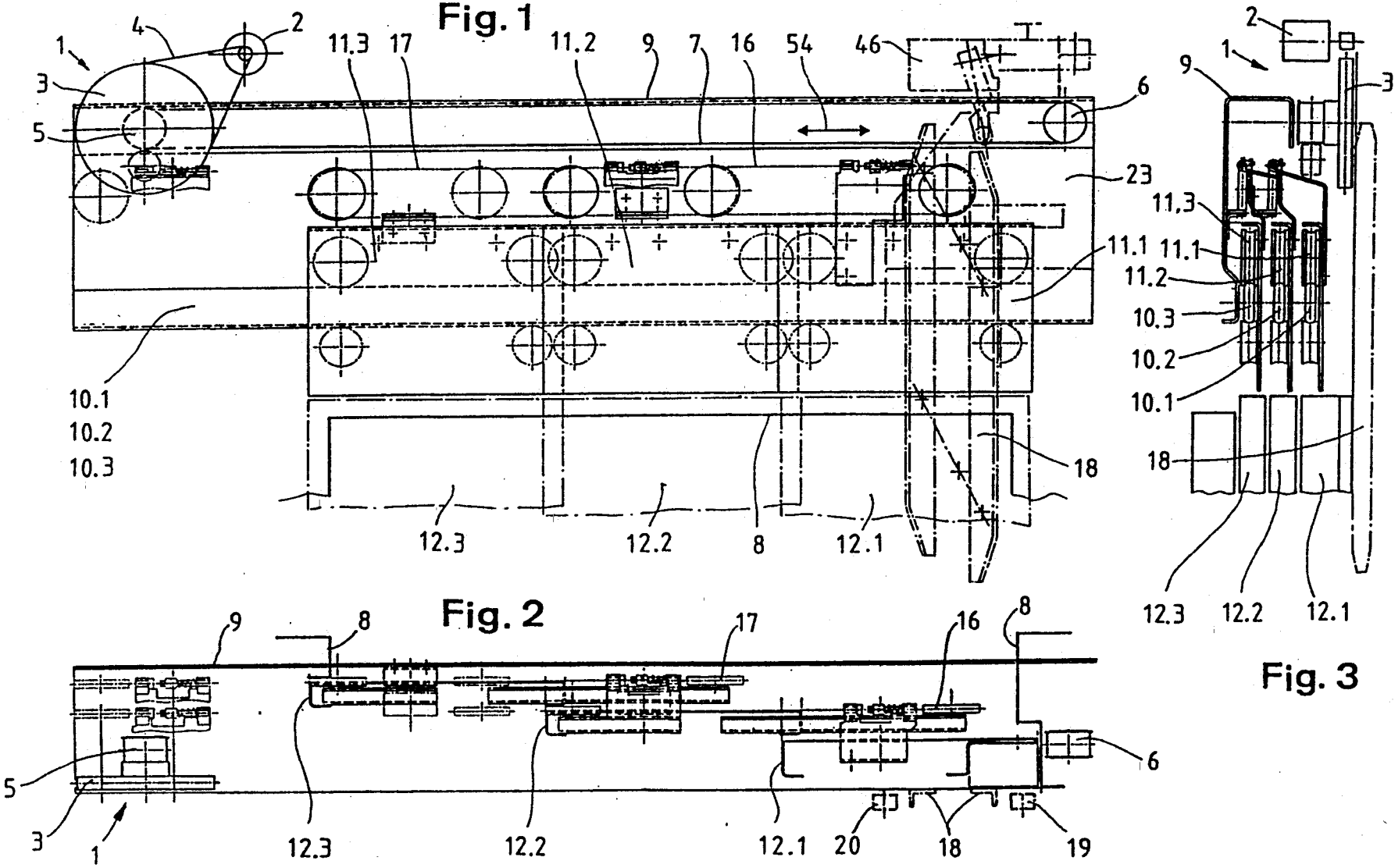
FIG. 1 is a fragmentary front elevation view of an elevator car door drive apparatus in accordance with the present invention with a three-leaf telescopically sliding car door, the door suspensions and the entraining member parallelogram.
FIG. 2 is a top plan view of the car door shown in the FIG. 1 with the door suspensions, the entraining member parallelogram and the coupling rollers of a shaft door.
FIG. 3 is a fragmentary side elevation view of the door drive device shown in the FIG. 1 with the door suspensions and the door leaves of the car door.
Figure 4:
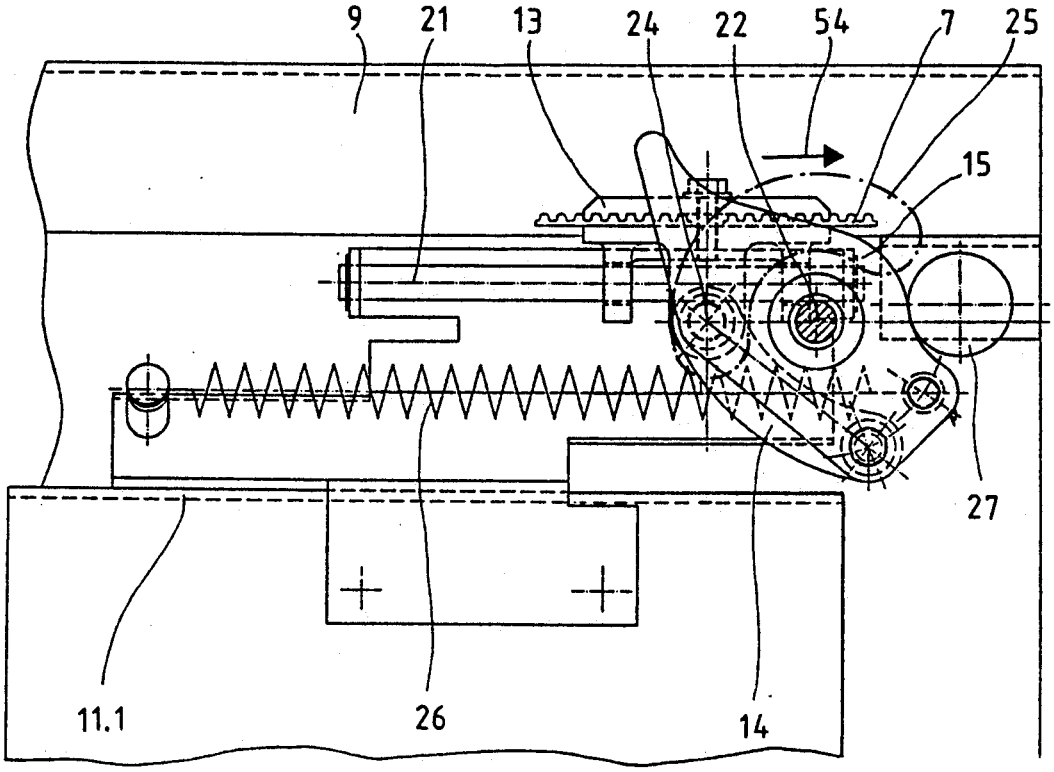
FIG. 4 is an enlarged from elevation view of a control cam for the actuation of the entraining member parallelogram shown in the FIG. 1 in a closed setting.

A door drive apparatus of a elevator installation is denoted by 1 in the FIGS. 1, 2 and 3. The door drive 1 includes a drive motor 2 rotating an intermediate gear 3 through a drive belt 4, a drive roller 5 connected for rotation with the gear 3, and a tensioned deflecting roller 6 connected to the roller 5 by a belted drive means 7. The door drive 1 is mounted on a sheet metal carrier 9 located on the roof of an elevator car above a door opening 8. Attached to the same sheet metal carrier 9 are a plurality of guide rails 10.1, 10.2 and 10.3 for the reception of associated sliding carriages 11.1, 11.2 and 11.3, which carriages each carry a respective individual door leaf 12.1, 12.2 and 12.3. The first sliding carriage 11.1 is connected with the belted drive means 7 by a clamping element 13, a toggle lever 14 and a control cam 15 as illustrated in the FIGS. 4 and 5. Both of the other sliding carriages 11.2 and 11.3 are connected by cable pulls 16 and 17 respectively for the entrainment each with the other and with the first sliding carriage 11.1.

The positions of an entraining member parallelogram 18 located at the first sliding carriage 11.1, a pivotally mounted car door latch 46, a fixed coupling roller 19 and a movable coupling roller 20 associated with the respective shaft door are illustrated in phantom lines. As shown in the FIGS. 4 and 5, the clamping element 13 is slidingly guided within a limited travel area on a sliding guide 21 located at the first sliding carriage 11.1. The control cam 15 is likewise rotatably mounted on a rotational axle 22 attached to a metal retaining plate 23 (FIG. 6) at the first sliding carriage 11.1 of the first door leaf 12.1 and projects by a hinge pin 24 into a cutout 25 of the metal retaining plate. The cam 15 is held in a closed setting (FIG. 4) through a tension force applied in the direction of an arrow 54 by the door drive 1 through the belted drive means 7 and is drawn into an open setting (FIG. 5) through an attached tension spring 26. In that case, a roller 27 located on the sheet metal carrier 9 serves as a riding roller for the periphery of the control cam 15.

The different settings of the entraining member parallelogram 18 and of the car door locking mechanism are illustrated in the FIGS. 6 through 9. The entraining member parallelogram 18 is mounted on a metal carrier plate 28 at the first sliding carriage 11.1. The parallelogram 18 includes two cams 29 and 30, which are pivotally connected with an upper lever 31 and a lower lever 32, which are in turn rotatably mounted on hinge pins 33 and 34 of the metal carrier plate 28. A pull rod 36, which connects the entraining member parallelogram 18 with the control cam 15, is mounted on an axle 35 on the lower lever 32. The pull rod 36 is equipped with a length equalization device 37 and has an abutment 38 for a double lever 39 and a ramp cam 40 for a support roller 41 fixedly mounted on the sheet metal carrier 23. The double lever 39 is rotatably connected at one end by a pin 42 with the pull rod 36, has a middle portion rotatably supported on the hinge pin 24, and has an opposite end abutting the cam 30. The double lever 39 is drawn into a rest position by the force of a tension spring 43 against the abutment 38 of the pull rod 36, the spring 43 being connected between the lever 39 and the rod 36. An elastic buffer 44 is provided on the hinge pin 24 of the control cam 15 in order to damp the opening movement of the control cam 15 at the end of the cutout 25. A rotary pin 45, on which a car door latch 46 is pivotally mounted, is provided at the upper end of the metal retaining plate 23. One end of an actuating strap 47 is rotatably mounted on the front portion of the car door latch 46 and the other end has actuating roller 49 guided in a groove 48 formed in the metal retaining plate 23. A latching roller 50 and a contact bridge 51, which cooperate with a latching cam 52 (FIG. 8) fastened at the sheet metal carrier 9 of the elevator car and an electrical safety contact 53 monitoring the locked position of the car door locking mechanism, are mounted at the rear portion of the car door latch 46.

The above-described apparatus operates as follows: The three-leaf telescopically sliding car door, which is shown in the FIGS. 1, 2 and 3, includes the three door leaves 12.1, 12.2 and 12.3, which are suspended by the three sliding carriages 11.1, 11.2 and 11.3 respectively running on the parallelly arranged guide rails 10.1, 10.2 and 10.3 respectively. The drive means 7 of the door drive 1 is connected with the door leaf 12.1, which leaf must traverse the longest distance for the opening or closing of the door opening 8. Both the other door leaves 12.2 and 12.3 are driven indirectly by way of the cable pulls 16 and 17 in such a manner that the middle door leaf 12.2 traverses two thirds of the travel distance and the third door leaf 12.3 traverses one third of the travel distance of the directly driven door leaf 12.1 at the same time. When the car door is open, all three door leaves 12.1, 12.2 and 12.3 lie one behind the other in exact congruency at the same time laterally outside the car door opening. In the closed state, the three door leaves 12.1, 12.2 and 12.3 lie one staggered behind the other and cover the door opening 8 entirely. When the car door drive 1 is actuated, it applies by way of the belted drive means 7 the tension force represented by the arrow 54 to the driven door leaf 12.1 and moves the sliding car door into the desired one of the open and closed settings.

The door drive, the entraining member parallelogram and the locking mechanism hold the car door locked during the travel of the car, unlock and couple together the car door and the shaft door at a destination floor in order that the shaft door is opened and closed together with the car door when actuated by the door drive, and lock both doors again before the car continues onward travel. Additionally, this apparatus meets the requirements that, in the case of a power failure, the car door must remain locked outside the door region of a floor, or the car door and the corresponding shaft door are unlocked automatically in the door opening region of the floor so that both doors can be opened together manually by a locked in passenger.

In the closed setting, the car door is locked by the driven door leaf 12.1 as shown in the FIGS. 1, 4, 6 and 8. The tension force represented by the arrow 54 engaging at the belted drive means 7 acts by way of the clamping element 13 and the toggle lever 14 on the control cam 15, which cam is urged against the force of the tension spring 26 along its periphery against the roller 27 firmly mounted on the sheet metal carrier 9. In that case, the pull rod 36 assumes the lowest setting and by way of the lower lever 32 urges both the cams 29 and 30 of the entraining member parallelogram 18 into the closed setting. The cams 29 and 30 of the entraining member parallelogram 18 move away from the fixed and movable coupling rollers 19 and 20 of the shaft door, during which the movable coupling roller 20 is displaced and locks the shaft door. A not illustrated safety contact monitors the locking of the shaft door electrically. At the same time, the pivotably mounted car door latch 46 is guided by its latching roller 50 over the latching cam 52, the car door is locked and the electrical safety contact 53 is closed by the contact bridge 51. In this state, the elevator car is ready for onward travel.

Figure 5:
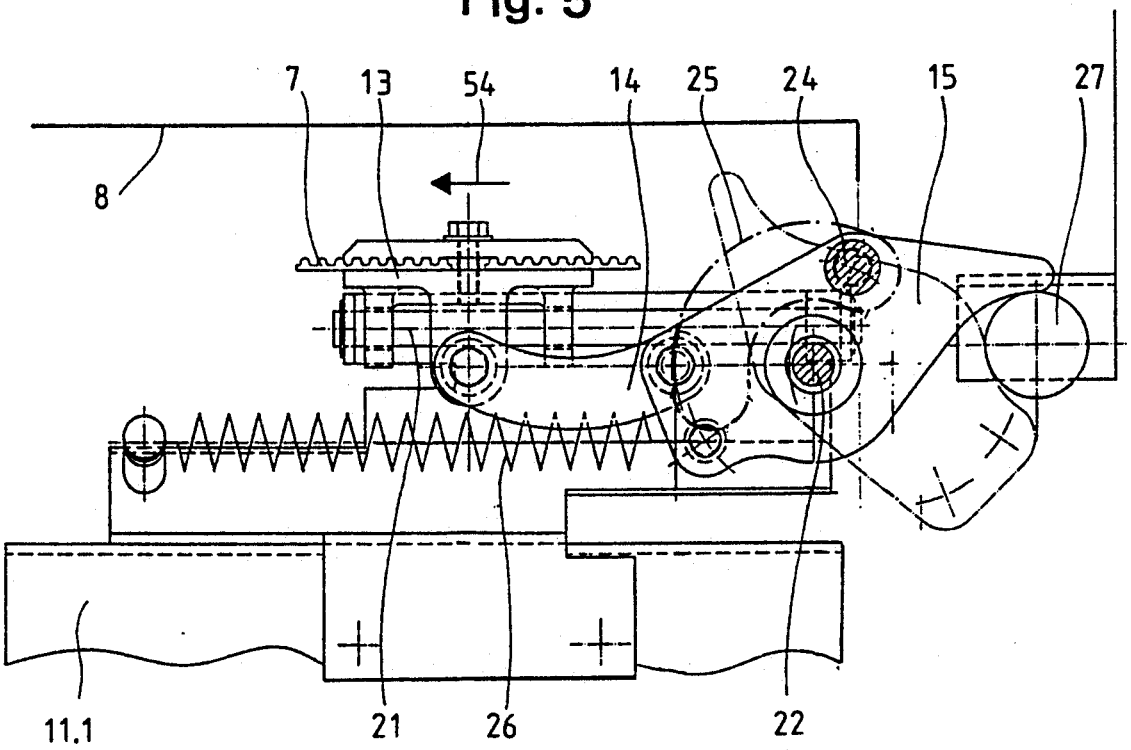
FIG. 5 is a view similar to the FIG. 4 showing the control cam for the actuation of the entraining member parallelogram in an opening setting.
Figure 6:
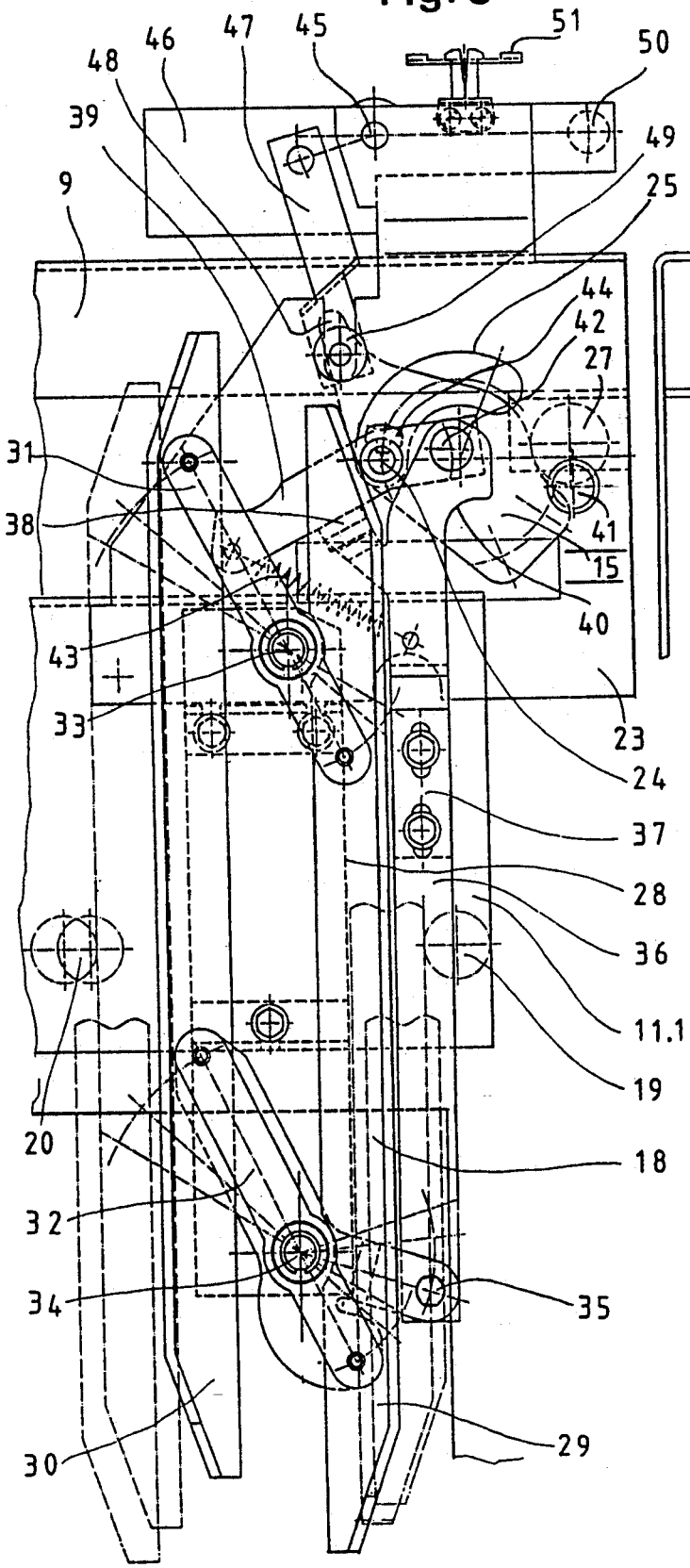
FIG. 6 is a fragmentary front elevation view of the entraining member parallelogram shown in the FIG. 1 in a closed setting with a locked car door latch and, indicated in phantom lines, both the other possible settings of the entraining member parallelogram in an open setting and in a half-open setting limited by the coupling rollers of a shaft door.
Figure 7:
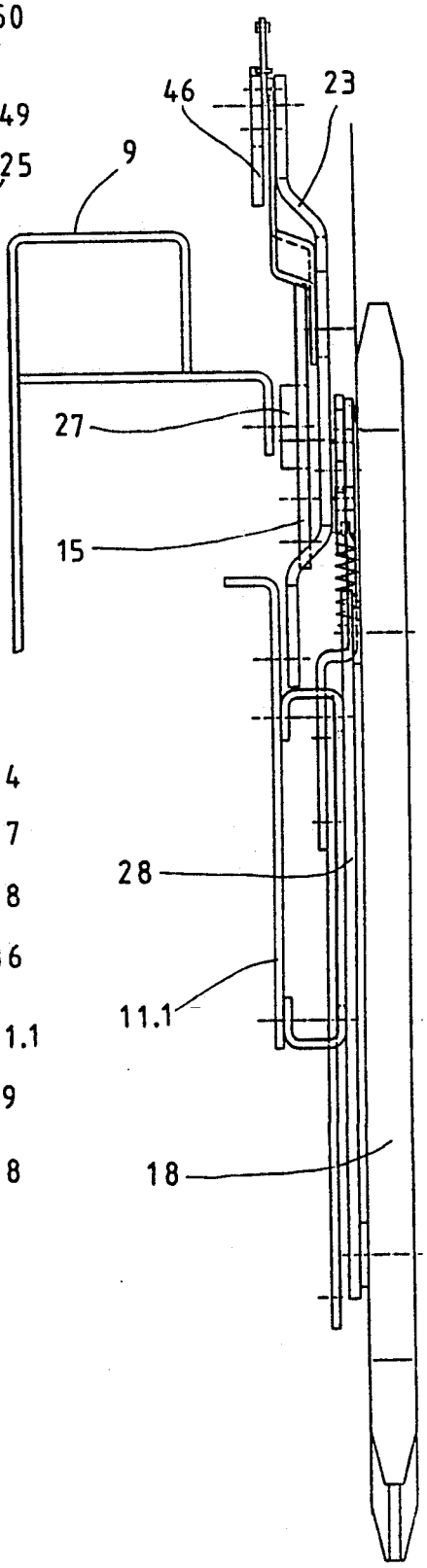
FIG. 7 is a side elevation view of the entraining member parallelogram shown in the FIG. 6.
Figure 8:
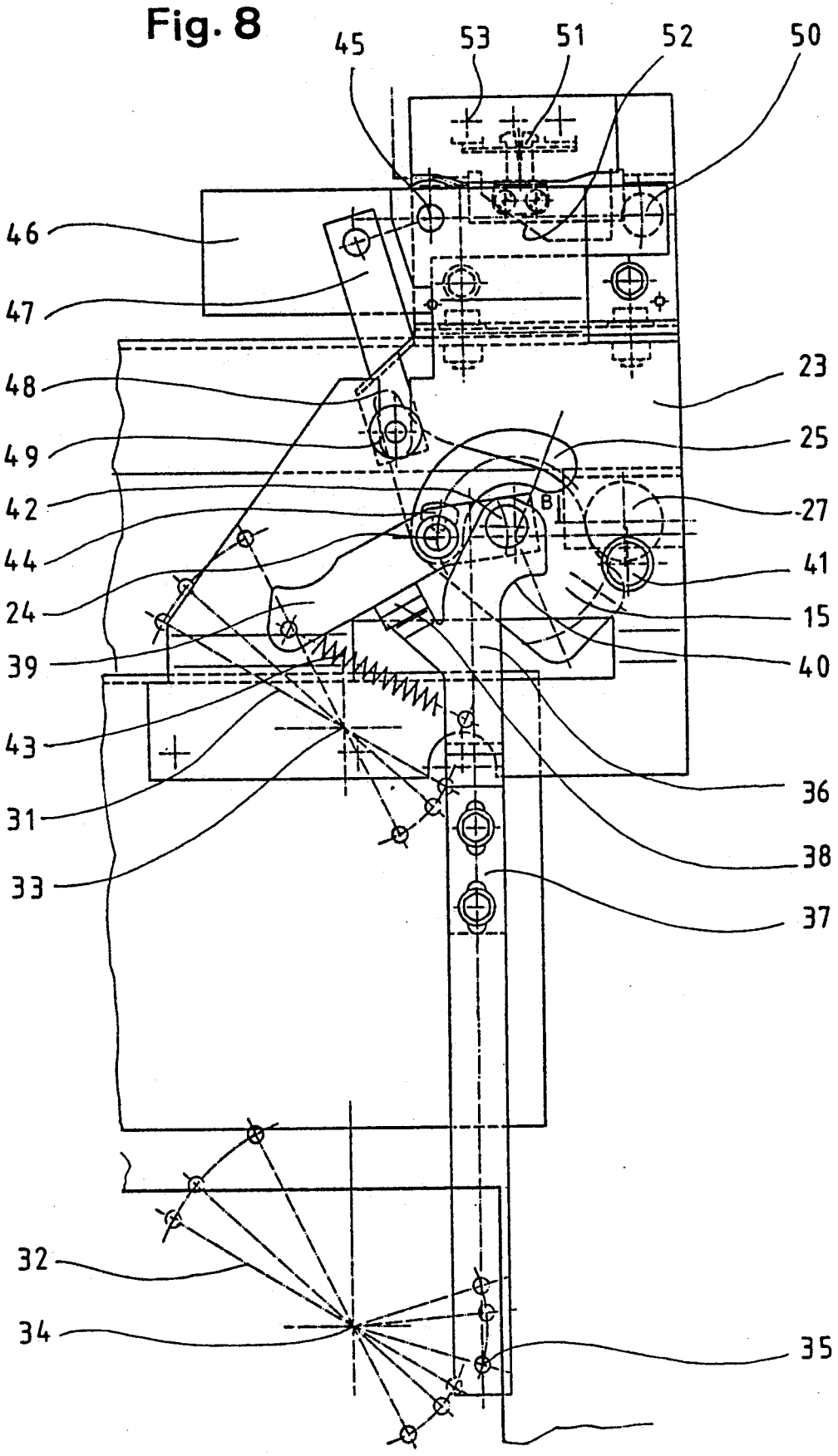
FIG. 8 is a fragmentary front elevation view of the car door locking mechanism in a locked setting with the control cam and a pull rod for the actuation of the entraining member parallelogram.
Figure 9:
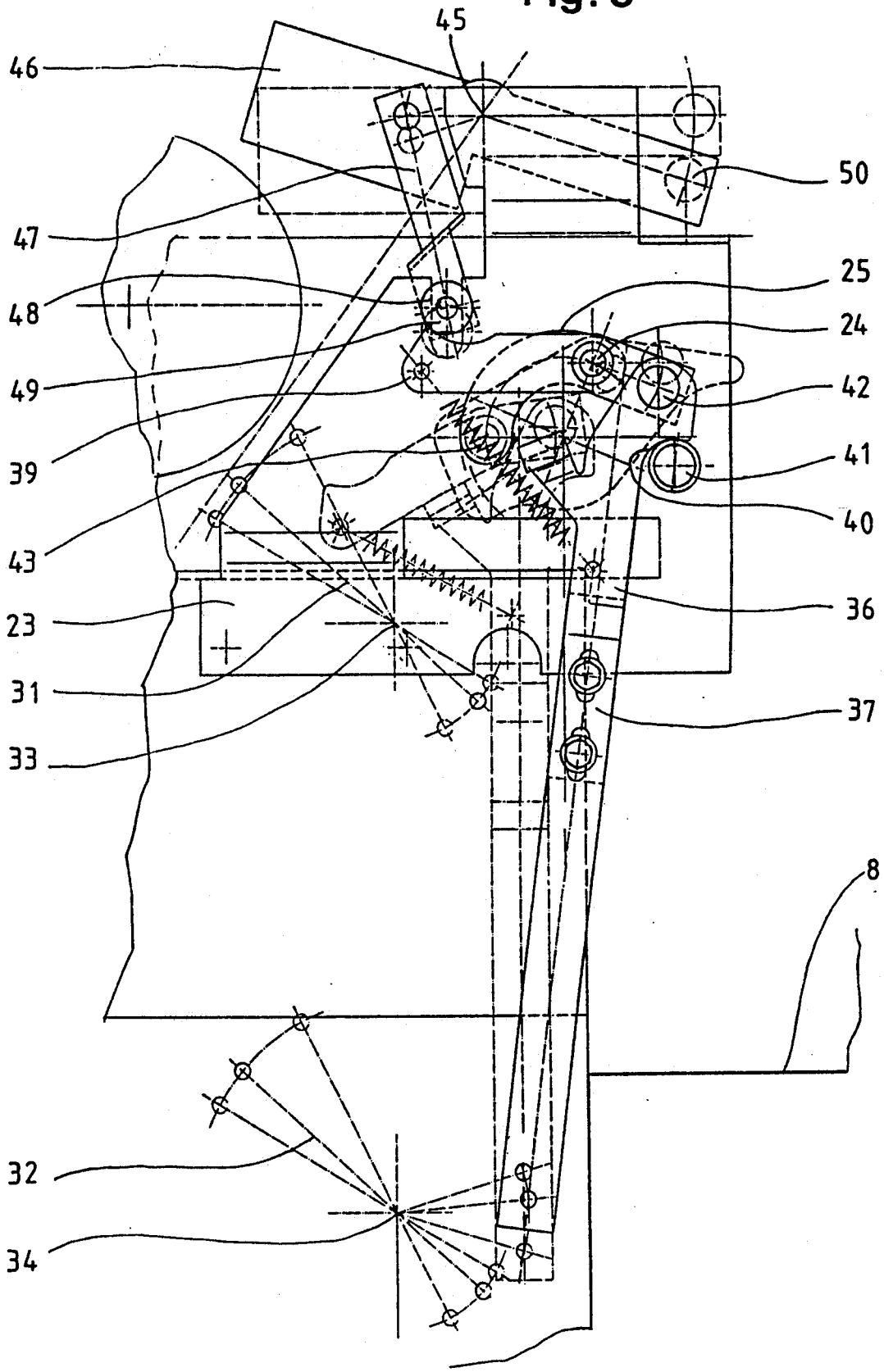
FIG. 9 is a view similar to the FIG. 8 showing the car door locking mechanism in an unlocked setting with the control cam, the pull rod for the actuation of the entraining member parallelogram, and a device for the unlocking of the car door locking mechanism.

On arrival at a destination floor, the door drive 1 is reversed and the tension force represented by the arrow 54 at the belted drive means 7 changes its direction (see FIGS. 5, 6 and 9). Before the sliding door executes a movement, the clamping element 13 is drawn along the sliding guide 21 in the opening direction, during which the control cam 15 is turned about the rotational axle 22 by way of the toggle lever 14 and the periphery of the control cam 15 rolls along the roller 27 firmly mounted on the sheet metal carrier 9. The periphery of the control cam 15 is so formed that a low-jerk opening and closing of the entraining member parallelogram 18 and the doors is assured on the closing end of the door path. The control cam rotates until the elastic buffer 44 on the hinge pin 24, which pin projects into the cutout 25 of the metal retaining plate 23, abuts the end of the cutout 25. In the meantime, the entraining member parallelogram 18 opens, being actuated by the pull rod 36 connected by way of the double lever 39 with the control cam 15, until both cams 29 and 30 of the entraining member parallelogram 18 abut the fixed and movable coupling rollers 19 and 20 of the shaft door. In that case, the movable coupling roller 20 is urged away through a predetermined distance and the shaft door unlocked thereby. The entraining member parallelogram 18 assumes the middle setting, which is indicated in phantom lines in the FIG. 6. The slightly obliquely set pull rod 36 is positioned with the ramp cam 40 on the supporting roller 41 and the double lever 39 is urged upwardly against the force of the spring 43, and the double lever 39 in its turn urges the actuating roller 49 of the car door latch 46 upwardly. In that case, the car door latch 46 is pivoted about the rotary pin 45 by way of the actuating strap 47 and the latching roller 50 is led out of the locking position. The car door can now be opened entirely by the door drive 1.

If an elevator car is situated within the door opening region of a floor and there is a power failure, the unlocking of the shaft door locking mechanism and the car door locking mechanism takes place in the same manner as illustrated above, with the exception that the force of the tension spring 26 takes the place of the tension force represented by the arrow 54. The tension force rotates the control cam 15, displaces the clamping element 13 through the belted drive means 7 in the sliding guide 21, opens the entraining member parallelogram 18 and unlocks the shaft door locking mechanism and the car door locking mechanism. A passenger, who has possibly been locked in, then has the possibility of opening the car door and the coupled-on shaft door together by hand.

If there is a power failure when a car door is situated outside the door opening zone of a floor, no unlocking of the car door locking mechanism takes place. In the case of a power failure, the tension force represented by the arrow 54 acting on the control cam 15 disappears again. The force of the tension spring 26 pulls on the control cam 15 and turns it about its rotational axle 22, while the periphery of the control cam 15 rolls along the roller 27 firmly mounted on the sheet metal carrier 9 until the elastic buffer 44 on the hinge pin 24, which pin projects into the cutout 25 of the metal retaining plate 23, abuts the end of the cutout 25. In that case, the clamping element 13 is displaced in the opening direction on the sliding guide 21 by the belted drive means 7 by way of the toggle lever 14 and the entraining member parallelogram 18 is opened by way of the pull rod 36. Since no coupling rollers 19 of a shaft door are present, the entraining member parallelogram 18 opens to its maximum width, while the pull rod 36 assumes the highest setting in which the double lever 39 is urged upwardly on the pull rod side and downwardly on the unlocking side about the hinge pin 24. The actuating roller 49 of the car door latch 46 is not displaced and the car door locking mechanism remains locked. A passenger, who has possibly been locked in, cannot open the car manually (see FIG. 8).

A telescopically sliding door with three door leaves is explained in the preceding description and illustrated in the FIGS. 1, 2 and 3. It is readily possible to equip any other kind of sliding door with the door drive apparatus according to the present invention, for example, also a centrally opening telescopically sliding door.

A different drive means, for example, a thrust crank drive, could also be provided in place of a belted drive means for the transmission of the opening and closing movements from the door drive to the door leaves.

At times different height shaft doors must be coupled with a door drive apparatus for the car door and be actuated for the same elevator. For example, the elevator may be required to actuate higher shaft doors at the ground floor and lower shaft doors at the remaining floors. The car and the car door are in that case designed for the highest shaft door. It is readily possible with the door drive apparatus according to the present invention to adapt the height position of the entraining member parallelogram for the coupling-on of the lowest shaft doors and to elongate the pull rod 36 for the operation of the car door locking mechanism at the upper end of a taller than normal car door leaf.

In accordance with the provisions of the patent statutes, the present invention has been described in what is considered to represent its preferred embodiment. However, it should be noted that the invention can be practiced otherwise than as specifically illustrated and described without departing from its spirit or scope.

What is claimed is:

1. In a door drive apparatus with locking mechanism for elevators, the elevators having a car door movable by a door drive and in the door opening zone of floors connectable through a coupling mechanism with a shaft door, wherein the coupling mechanism includes an entraining member parallelogram mounted on a car door leaf and two coupling rollers respectively positioned at each shaft door, the door drive including a drive motor mounted on the car driving a drive means which is connected through an actuating device with the car door and moves the car door to the closed and the open settings, and the locking mechanism includes a pivotably mounted car door latch which is monitored by a safety contact, is arrestable at an abutment, locks by its own weight in a retaining position and which is urgeable by the actuating device into a releasing position, the actuating device comprising:

a control cam rotatably mounted on an elevator car door for actuating an entraining member parallelogram by way of a pull rod attached to the entraining member parallelogram, said control cam being rotatably mounted on a sliding carriage of a sliding door leaf of the elevator car door and being attached to the pull rod;

a hinge pin attached to said control cam and projecting into a cutout formed in a metal retaining plate attached to the elevator car door;

an elastic buffer attached to said hinge pin for abutting an end of the cutout to limit rotation of said control cam in an opening direction;

a toggle lever connected between said control cam and a drive means for the elevator car door; and a roller fixedly and rotatably attached to the elevator car and abutting a periphery of said control cam.

2. The actuating device according to claim 1 including an actuating strap having an actuating roller attached to one end guided in a groove formed in a metal retaining plate attached to the elevator car door and being pivotally connected at an opposite end to a car door latch, said actuating strap being urgeable upwardly by a double lever, said double lever being rotatably mounted on said control cam and pivotally connected at one end with the pull rod, an opposite end of said double lever abutting said actuating roller upon upward movement of the pull rod.

3. The actuating device according to claim 2 including an abutment formed on the pull rod for retaining said double lever in a rest position, said double lever being urged into the rest position by the force of a tension spring connected between said double lever and the pull rod.

4. The actuating device according to claim 1 including a ramp cam mounted on the pull rod which, in an open position of the entraining member parallelogram, contacts a support roller attached to the elevator car door.

5. The actuating device according to claim 1 including a length equalization device attached to the pull rod for adjusting the pull rod to a predetermined length.

6. A door drive apparatus with locking mechanism for an elevator, the elevator having a car door movable by a door drive and in the door opening zone of floors connectable through a coupling mechanism with a shaft door, wherein the coupling mechanism includes an entraining member parallelogram mounted on a car door leaf and two coupling rollers respectively positioned at each shaft door, the door drive including a drive motor mounted on the car driving a drive means which is connected through an actuating device with the car door and moves the car door to the closed and the open settings, and the locking mechanism includes a pivotably mounted car door latch which is monitored by a safety contact, is arrestable at an abutment, locks by its own weight in a retaining position and which is urgeable by the actuating device into a releasing position, comprising:

an entraining member parallelogram mounted on a car door of an elevator;

a control cam rotatably mounted on the car door for actuating said entraining member parallelogram;

a hinge pin attached to said control cam and projecting into a cutout formed in a metal retaining plate attached to the car door;

an elastic buffer attached to said hinge pin for abutting an end of the cutout to limit rotation of said control cam in an opening direction;

a pull rod connected between said entraining member parallelogram and said control cam;

a toggle lever connected between said control cam and a drive means for the car door for rotating said control cam when the drive means moves the car door; and a roller fixedly and rotatably attached to the elevator car and abutting a periphery of said control cam.

7. The actuating device according to claim 6 including an actuating strap having an actuating roller attached to one end guided in a groove formed in said metal retaining plate and being pivotally connected at an opposite end to a car door latch, said actuating strap being urgeable upwardly by a double lever, said double lever being rotatably mounted on said control cam and pivotally connected at one end with said pull rod, an opposite end of said double lever abutting said actuating roller upon upward movement of said pull rod.

8. The actuating device according to claim 7 including an abutment formed on said pull rod for retaining said double lever in a rest position, said double lever being urged into the rest position by the force of a tension spring connected between said double lever and said pull rod.

9. The actuating device according to claim 6 including a ramp cam mounted on said pull rod which, in an open position of said entraining member parallelogram, contacts a support roller attached to the car door.

10. The actuating device according to claim 6 including a length equalization device attached to said pull rod for adjusting said pull rod to a predetermined length.

11. A door drive apparatus with locking mechanism for an elevator, the elevator having a car door movable by a door drive and in the door opening zone of floors connectable through a coupling mechanism with a shaft door, wherein the coupling mechanism includes an entraining member parallelogram mounted on a car door leaf and two coupling rollers respectively positioned at each shaft door, the door drive including a drive motor mounted on the car driving a drive means which is connected through an actuating device with the car door and moves the car door to the closed and the open settings, and the locking mechanism includes a pivotably mounted car door latch which is monitored by a safety contact, is arrestable at an abutment, locks by its own weight in a retaining position and which is urgeable by the actuating device into a releasing position, comprising:

an entraining member parallelogram mounted on a car door of an elevator;

a control cam rotatably mounted on the car door for actuating said entraining member parallelogram;

a hinge pin attached to said control cam and projecting into a cutout formed in a metal retaining plate attached to the car door, and an elastic buffer attached to said hinge pin for abutting an end of the cutout to limit rotation of said control cam in an opening direction;

a pull rod connected between said entraining member parallelogram and said control cam;

a toggle lever connected between said control cam and a drive means for the car door for rotating said control cam when the drive means moves the car door;

a roller fixedly and rotatably attached to the elevator car and abutting a periphery of said control cam;

an actuating strap having an actuating roller attached to one end guided in a groove formed in said metal retaining plate and being pivotally connected at an opposite end to a car door latch;

a double lever being rotatably mounted on said control cam and pivotally connected at one end with said pull rod, an opposite end of said double lever abutting said actuating roller upon upward movement of said pull rod and urging said actuating strap upwardly;

an abutment formed on said pull rod for retaining said double lever in a rest position, said double lever being urged into the rest position by the force of a tension spring connected between said double lever and said pull rod;

a ramp cam mounted on said pull rod which, in an open position of said entraining member parallelogram, contacts a support roller attached to the car door; and a length equalization device attached to said pull rod for adjusting said pull rod to a predetermined length.

* * * * *